US005702283A

United States Patent [19]

Watson, Jr. et al.

[11] Patent Number: 5,702,283

[45] Date of Patent: Dec. 30, 1997

[54] REAL SOUNDS TOY ENGINE

[75] Inventors: Daniel M. Watson, Jr., Moorestown, N.J.; Melvin Mednick, New City, N.Y.; Thomas M. McKeon, Mt. Laurel, N.J.

[73] Assignee: Larami Limited, Mount Holly, N.J.

[21] Appl. No.: 657,780

[22] Filed: May 31, 1996

[51] Int. Cl.[6] ..... A63H 5/00

[52] U.S. Cl. ..... 446/397; 434/373; 434/389

[58] Field of Search ..... 446/7, 397, 409, 446/404, 484, 485; 434/373, 374, 389, 393

[56] References Cited

U.S. PATENT DOCUMENTS

| | | | |
|---|---|---|---|
| 2,639,544 | 5/1953 | Coffin | 446/484 |
| 4,274,225 | 6/1981 | Knauff et al. | 446/7 X |
| 4,291,877 | 9/1981 | Ensmann et al. | 446/444 |
| 4,932,913 | 6/1990 | Raviv et al. | 446/7 |
| 4,997,404 | 3/1991 | May | 446/409 |
| 5,045,016 | 9/1991 | Stern et al. | 446/409 |
| 5,195,920 | 3/1993 | Collier | 446/409 |
| 5,217,402 | 6/1993 | Gross et al. | 446/397 X |
| 5,273,478 | 12/1993 | Yamasaki | 446/409 |
| 5,306,197 | 4/1994 | Watanabe | 446/409 |
| 5,314,372 | 5/1994 | Kramer | 446/409 X |
| 5,330,380 | 7/1994 | McDarren et al. | 446/397 |
| 5,389,031 | 2/1995 | Sharpe, III et al. | 446/409 |

*Primary Examiner*—Mickey Yu

*Attorney, Agent, or Firm*—Kenneth P. Glynn, Esq.

[57] ABSTRACT

The present invention is a real sound-producing toy engine. It includes a main housing having a simulated automobile engine exterior and a plurality of activation sites located at the main housing for activating a plurality of different real sounding motor-related sounds. It also includes a plurality of switches, there being at least one for each of the activation sites which is connected thereto. Each of the switches has an off-position and an on-position, each of the switches being also connected to at least one sound-producing mechanism. There is an engine start-up activation site at the main housing and a switch connected to the engine start-up activation site, with sound-producing device capable of producing an engine start-up sound, including a running engine sound which simulates an idling engine, and at least one power source connected to the foregoing. In some embodiments there is an oil fill port activation site having a pressure switch and simulated oil container. There may also be a spark plug, a distributor cap, wires and a sparking switch activation site. In addition, the main housing may also include an air filter and a valve cover.

20 Claims, 2 Drawing Sheets

REAL SOUNDS TOY ENGINE

BACKGROUND OF THE INVENTION

1. Field of the Invention

The present invention involves novel sounding toys and, more specifically, toy engines that have real sounds. These toy engines have real engine appearances that include the outer structures internal combustion engines with spark plug wires, ignition key, oil fill port, and other features. The real sound effects are achieved so as to simulate ignition, rough running, idle adjustment to smooth running, oil filling, etc. The child can thus be entertained and amused while experiencing simmulations of actual internal combustion engine activities.

2. Information Disclosure Statement

The following prior art patents are representative of toys or toy related products with sound related systems:

U.S. Pat. No. 5,389,031 describes a toy assembly which includes a base toy unit, a plurality of accessories which are removably receivable in predetermined positions on the base toy unit, a plurality of switch assemblies for detecting the absence or presence of the accessories relative to the respective predetermined positions thereof and a control unit which is responsive to the switch assemblies for issuing prerecorded sound effect, including voice messages. The sound effect are preferably related to the removal or repositioning of the accessories relative to the respective predetermined positions thereof on the base toy unit for leading, responding to and reinforcing the activity of a child in a play format. The base toy unit is preferably embodied as a toy vehicle, the accessories are preferably formed as accessories which are related to the vehicle and the sound effect are preferably related to the vehicle and the accessories.

U.S. Pat. No. 5,330,380 describes a unique audible message or information delivery system particularly suited for toys which is realized by providing each model or type of toy in a particular group or class with a unique identification code and also providing a message delivery and handling assembly which incorporates a plurality of independent messages, each of which are specifically related to one particular toy model and are constructed for being delivered by the message delivery assembly upon receipt of the particular identification code. In this way, whenever a toy model interfaces with the information/message delivery assembly, the unique, identifying code associated with the model is received by the information/message delivery assembly and is processed for activating the audible presentation of the specifically designated message associated with that particular model. By employing this invention, every different model or type of toy in a group or class of toys is able to interface with the same information/message delivery assembly and cause a different, unique, specifically designated message to be audibly delivered. By providing an audio producing information delivery assembly uniquely constructed for a particular group or class of toys, any toy group or class is capable of being constructed with identification codes associated therewith for having specifically designated messages audibly delivered in response to receipt of a particular code.

U.S. Pat. No. 5,306,197 describes a key action, movable toy of the present invention which moves in response to a turning action of a switch key. The toy generates a starting sound and an engine sound. A key switch mechanism which has three positions, off, on and starting, energizes a power unit, which moves the toy, to an on-state. The energizing occurs in response to a switch key moving from the off-position to the starting position and to the on-position. The power unit will stay on when on the on-position, and a sound generation mechanism will switch from the starting sound to an engine sound when the switch key moves to the on-position. The toy will move in response to a lever which controls whether the toy will move or stay stationary.

U.S. Pat. No. 5,273,478 describes a toy vehicle which includes a generally rectangular hollow supporting chassis and a replica vehicle body pivotally secured to the chassis at the front portion. A return spring resiliently biases the rear portion of the truck body in a generally horizontal position. A battery power unit and electric motor are supported within the vehicle chassis and coupled to the vehicle wheels by a gear coupling mechanism. The gear coupling mechanism is engageable and disengageable by a shift lever extending upwardly from within the vehicle chassis to beyond the vehicle body. A sound unit includes a sound drum and a flexible reed supported closely thereto. A plurality of extending tabs within the drive gear system are operative upon motor rotation to flex and release the spring reed against the drum head sound unit to produce engine sounds. A heavy flywheel is coupled to the motor drive system and produces gradual slow-down when the motor is disengaged. An electric switch is interposed between the battery power unit and the motor is operable by either pivotal motion of the truck body when the user presses downwardly upon or by the positioning of the shift lever in the engaged position.

U.S. Pat. No. 5,217,402 describes a sound producing workbench toy which includes a molded plastic base supporting a molded plastic work surface. A work station formed of a molded plastic material defines a plurality of receptacles within which various tools and accessories such as simulated nails, screws or bolts may be received. Switch mechanisms within the receptacles are coupled to conventional sound producing circuits and are operative in response to the manipulation of inserted tools, screws, bolts or the like to energize the sound circuits at the appropriate time.

U.S. Pat. No. 5,045,016 describes a toy wheeled vehicle such as a toy truck which is intended to be pushed along by a child includes electronic circuitry which is capable of emitting a plurality of different sounds similar to the sounds of a real truck. The actual sound of a truck's internal combustion engine is digitized and stored in a microprocessor along with other sounds such as those generated by a starter motor, horn, backup beeper and the like. In addition, the microprocessor is capable of synthesizing additional realistic vehicle sounds such as those generated by air brakes and the like. A starter switch first activates the starter motor sound and then the engine sound at idle speed. A speed sensor senses both speed and direction of travel and varies the engine sound in response to the sensed speed. The backup beeper sound is automatically generated along with the engine sound when the truck is moved in reverse. The microprocessor not only stores all of the digitized sounds but also controls all of the operations of the truck.

U.S. Pat. No. 4,997,404 describes a toy vehicle incorporating a sound effect generator similar to an acoustical phonograph having a machined turntable with mutually exclusive sound tracks, each of the sound tracks creating a different sound effect through a tone arm and speaker cone arrangement. The turntable is driven by a gear train from the wheels of the vehicle. Selection of the various sound effects is made by movement of the vehicle in response to the normal forces of the play pattern on the vehicle causing the tone arm to engage different ones of the sound tracks.

U.S. Pat. No. 4,932,913 describes a hand held control device for use by a child to simulate directional and speed control of a vehicle, which device includes a wheel for grasping by the hands of a child at opposed parts thereof, a plurality of electrical switches on the device operable to provide signals for predetermined operations of the device, the switches being positioned on the device to be operable by the fingers of a child while the child's hands are engaging the wheel, a main housing member, a controller and a sound generating device in the main housing member, the controller including a memory storing data representative of sounds created or creatable by the simulated vehicle including sounds simulating the sounds generated when the simulated vehicle is in motion, the sound generating device being coupled to said controller to convert stored data into audio, the finger operated switches providing input signals to the controller to cause the controller to produce sound data to the sound generating device for audio generation.

U.S. Pat. No. 4,291,877 describes an engine-sound accessory for an electric toy vehicle which produces a sound output which varies its characteristics in proportion to an electric input to the toy vehicle. The apparatus measures the total electric current fed to the toy vehicle to produce a sound control signal proportional thereto. When two or more vehicles are fed from a common power source, the apparatus is responsive to the sum of the electric current fed to the two or more vehicles whereby variation in the electric current fed to one or both of the vehicles produces a corresponding variation in the sound characteristic.

U.S. Pat. No. 2,639,544 describes a construction toy kit comprising a plurality of imitation internal combustion engine parts from which a variety of imitation internal combustion engine types may be assembled. The kit includes imitation engine cylinders, a solenoid contained within each imitation cylinder, a sleeve axially mounted within each solenoid to form an imitation cylinder wall and, a plurality of armatures to imitate internal combustion engine pistons. One of the armatures is to be mounted within each of the imitation cylinder walls for reciprocation therein. A plurality of brackets is provided for mounting the imitation cylinders, solenoids, and cylinder walls. An open frame on which the brackets and the parts assembled thereon may be removably mounted for assembling the parts to simulate an internal combustion engine. A plurality of dielectric cams are provided to simulate the valve-actuating cams of an internal combustion engine. A plurality of dielectric brackets are mounted on the frame, one adjacent each of the imitation engine cylinders. A plurality of imitation poppet valves, one to be mounted on each of the last-mentioned brackets adjacent one of the imitation cylinders and to be reciprocated by the dielectric cans, where each of the imitation popper valves includes an electrical conducting portion. An imitation crankshaft is journaled in the frame and is connected to the armatures to be rotated by the armatures as they reciprocate within the imitation cylinder walls, rotation of the crankshaft rotating the dielectric cams to cause reciprocation of the imitation popper valves. Spaced electrical contacts are connected to a source of electrical energy and to the solenoids and are opened and closed by the conducting portions of the imitation poppet valves as the imitation poppet valves are reciprocated by the dielectric cams to effect alternate actuation of the solenoids to simulate alternate operation of the cylinders and pistons of an internal combustion engine.

Notwithstanding the prior art, the present invention is neither taught nor rendered obvious thereby.

SUMMARY OF THE INVENTION

The present invention is a real sound-producing toy engine. It includes a main housing having a simulated automobile engine exterior and a plurality of activation sites located at the main housing for activating a plurality of different real sounding motor-related sounds. It also includes a plurality of switches, there being at least one for each of the activation sites which is connected thereto. Each of the switches has an off-position and an on-position, each of the switches being also connected to at least one sound-producing means. This is an engine start-up activation site at the main housing and a switch connected to the engine start-up activation site, with sound-producing device capable of producing an engine start-up sound, including a running engine sound which simulates an idling engine, and at least one power source connected to the foregoing. In some preferred embodiments, the sound-producing device of the engine start-up activation site is capable of producing an engine start-up sound, with a rough running engine sound which audibly produces intermittent sound of differing periodicity and there is further included an idle adjustment activation site and an idle switch. This site has a rotatable member connected to the idle switch, which is connected to the engine start-up activation site, for overriding the rough running engine sound so as to activate a sound-producing means having a smooth running sound with intermittent sounds of substantially fixed periodicity.

BRIEF DESCRIPTION OF THE DRAWINGS

The present invention should be more fully understood when the specification herein is taken in conjunction with the drawings appended hereto wherein.

DETAILED DESCRIPTION OF THE PRESENT INVENTION

Figure 1:
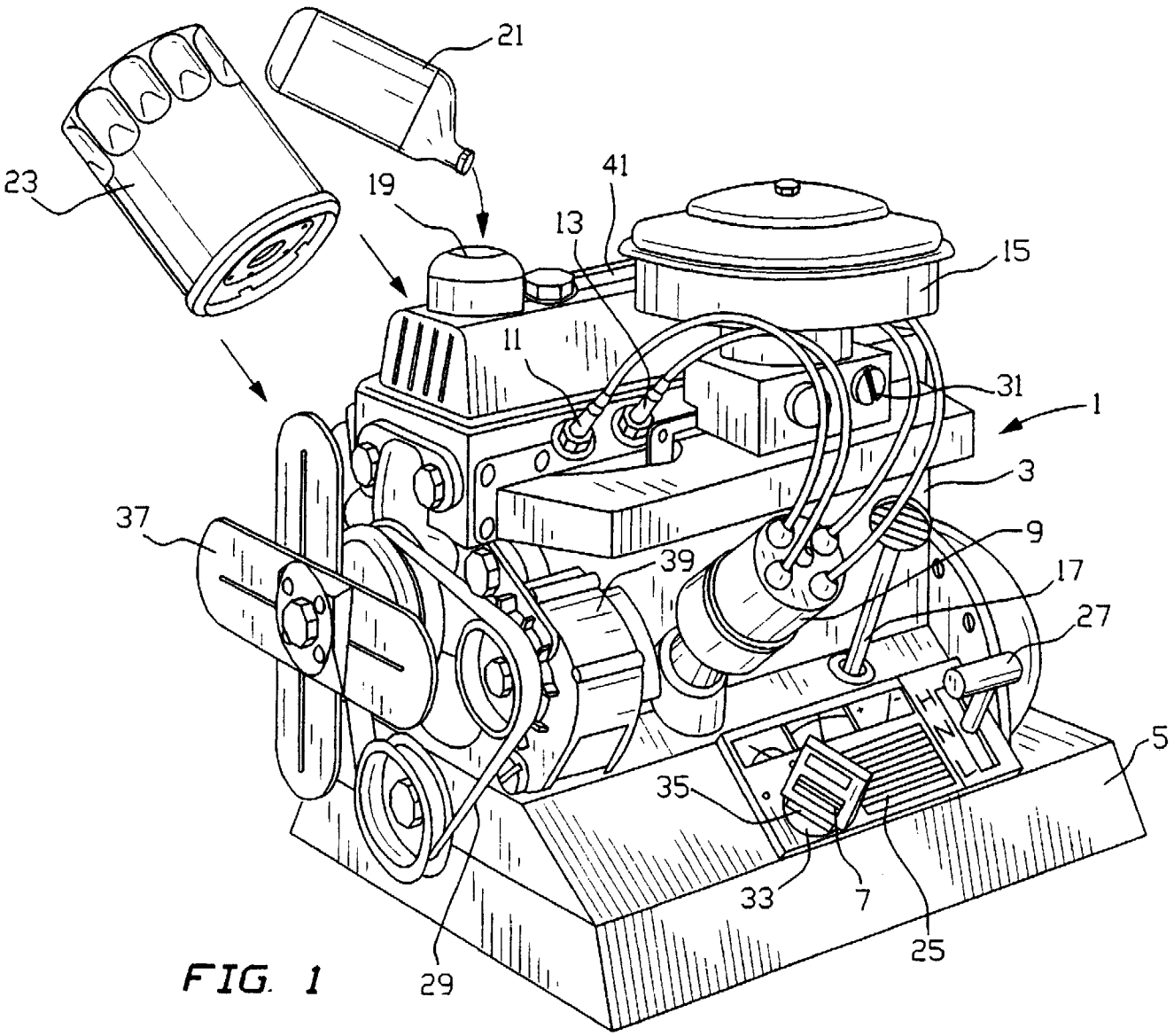
FIG. 1 shows an oblique view of a present invention toy engine device.

The present invention is a real sound-producing toy engine. It includes a main housing which has a simulated automobile engine exterior. This main housing may be constructed of metal or plastic or other material of construction, but is preferably molded with plastic with metalized aspects, as may be desired. The shape of the engine may be a V-8 shape, a V-6 shape, an in-line engine, a rotary engine or any other engine which exists or may come into existence. The actual shape of a main housing is not critical, provided that it presents to the user a simulated engine.

The main housing of the present invention has a plurality of activation sites located at various points. By "activation sites" is simply meant an area where a user may turn, twist, push, pull, or otherwise move some object to move a switch from a first off-location to a second on-location to activate a sound-producing mechanism located within the toy engine of the present invention. Thus, the present invention also includes a plurality of switches. There are at least one switch for each activation site which is connected to the activation site itself. By being connected to the activation site is meant that it is located in, on or wired to or mechanically connected to an activation site. In most preferred embodiments, the activation site will contain one or more switches which are hidden to the user but are externally activatable by insertion or rotation or pushing or pulling. The switches are also connected to a power source. The switches need not be directly connected to a power source and may either directly be connected or indirectly be connected. Thus, in the case of an idle adjuster mechanism, it may be wired to a power source by going through a start-up mechanism. This will become more evident with the disclosure below.

One critical feature of the present invention toy engine device is an engine start-up activation site located at the main housing with a switch which is connected to a sound-producing means capable of producing an engine start-up sound. This would include a running engine sound which simulates an idling engine. In preferred embodiments, it would simulate the actual sound of a turning over of an engine followed by an idling sound. In some embodiments, the idling sound may be smooth, but in preferred embodiments the idling sound would be rough running. Thus, when the idling sound is smooth, there would be sound emitting at a fixed or a substantially fixed periodicity whereas if it were a rough idling engine there would be erratic or variable periodicity to the engine sound. In another preferred embodiment, the engine sound-producing mechanism may include some revving features. These revving features would be the sound of a revving engine which may occur automatically as part of the starting sound sequence or may be separately connected to a shift lever or an acceleration lever which would kick in a racing engine sound.

As mentioned, the power source is included and this would typically be a battery operated toy device.

The engine start-up activation site may preferably be a rotatable keyhole with a first position representing an off-position and the second position representing an on-position. The keyhole may have a permanently molded key extending therefrom and the user may simply rotate the key to "start-up" the engine. Alternatively, the key may be removably and would teach the child the concept of inserting the key and then rotating it to start the engine.

The present invention toy engine device may include an oil fill port as an activation site with a proper switch therein for simulating the sound of oil being poured into an engine with the usual oil bubble "glub, glub, glub" sound. Thus, one sound-producing means which may be used in the present invention device would be the oil fill sound. This does not have to be "glub" but could be any other similar sound such as "glug, glug, glug". One embodiment may involve a pressure-activated switch. This would involve a piston and spring, for example, and, by the insertion of something into the fill hole, the switch would be activated, that ms, would be moved from its off-position to its on-position. When this occurs, the sound-producing means would produce the oil filling sound. In a preferred embodiment, a simulated container of motor oil is provided and an oil fill cap is removed and when the nozzle of the container is pressed into the oil fill port, the sound is activated.

The present invention toy engine device will include, in its preferred embodiments, spark plugs, spark plug wires and a distributor cap. It may also include an oil filter, a fan, a fan belt and other features. It may also include an oil dipstick for simulated measurement of oil. It may also include a removable air filter for simulation of replacing an oil filter. It may also actually have a motor driven, rotateable fan belt. In preferred embodiments it would have a supporting base which would constitute an integrally formed permanent mount for the toy engine. Other features should now be apparent without exceeding the scope of the present invention.

In a preferred embodiment of the present invention, the distributor cap or the spark plug or spark plug wires may be removed to activate a switch which would produce the sound of sparking which would be typical when a real engine is running and a spark plug wire or cap is removed to create a sparking gap. Additionally, there may be included a simulated label area or a dashboard printed on or molded or otherwise formed gauges and/or instructions. Finally, there should be provided a removable cover to access batteries for replacement. This is well known in the art of battery operated toys and need not be elaborated upon.

In a most preferred embodiment of the present invention, there is included an idle adjustment activation site with an idle switch. This idle switch enables the user to move the idle switch from an off-position to an on-position so as to activate a smoother running engine. Thus, this would be used in the embodiment of the present invention toy engine device wherein after initial start-up the engine would be running rough. The user would then activate the idle adjustment switch and a smoother running sound would be produced. In this embodiment, the idle adjustment switch would override the rough sound and create a smooth sound from a sound-producing means. This idle adjustment switch could be a rotatable protrusion, a shifting lever, or a screw head with two positions wherein a child could use a toy screw driver to rotate the idle adjustment screw and kick in the smooth running sound.

The sound-producing means utilized in the present invention are well known in the art in that many toys today exist with sound-producers. This is evident from the Prior Art cited in the Information Disclosure Statement above. These sounds may be digital, or otherwise created and may actually be reproductions of sounds taken from actual engines. The exact details of the chips used to create these sounds are well within the skill of the artisan.

Referring now to FIG. 1, there is generally shown a present invention real sound-producing toy engine device 1. Main housing 3 is shown, which, is formed to simulate a real engine and it includes various engine-like features, including an alternator 39 and a cover 41, as well as a fan belt 29 and fan 37. There is a main housing base 5 which acts as a horizontal support and permanent engine mount. This may be unistructurally cast with a portion of the engine and the actual details of the casting and assemblages also well within the artisan's skill.

There is a start-up activation site 7 which includes a key 35 and keyhole 33 with a switch located thereunder. This switch will be activated when the key is rotated from left to right and thus, from its off-position to its on-position. Activation may be initially cause a sound-producing mechanism to produce an engine turning over or an engine revving. It may produce an engine turning over followed by an engine revving. In either case, there is subsequently an idling engine sound and this may be smooth running or it may be rough running. In this embodiment shown in FIG. 1, it would be a rough running engine sound. There is a distributor cap 9 with spark plugs 11 and 13, as shown as well as a removable air filter 15 and a removable oil filter 23. There is an oil dipstick 17 which may be taken out and inserted and may have gradations thereon for user to pretend to check the oil level. There is an oil fill cap 19 which is removable and a oil fill port thereunder for insertion of simulated oil container 21. This would constitute another activation site and the switch would be activated by the top of container 21 being pushed down into the oil fill port to produce an oil pouring sound such as the glub, glub, glub sound mentioned above.

FIG. 1 also shows a panel 25 with various gauges located thereon as well as a simulated shift lever 27. In this preferred embodiment, there is an idle adjustment screw 31 which constitutes an idle adjustment activation site. Idle adjustment screw 31 is connected to an idle adjustment switch. When a user inserts a screw driver into this idle adjustment screw 31 and rotates it, a switch is shifted from its off-position to its on-position and an overriding smooth idling sound kicks in and shuts off the rough idling sound which was initiated when key 35 was rotated to activate the engine start-up switch. Fan belt 29 and fan 37 may, optionally, rotate slowly and in such a manner so as not to hurt a child. In fact, in the rotational mode, fan belt 29 would ideally be flexible rubber rather than plastic. Detailing may be utilized such as metalization of cover 41 and certain other parts of the device. Thus, air filter 15, fan 37, alternator 39 and cover 41 may be aluminumized or otherwise metalized coated plastic.

Figure 2:
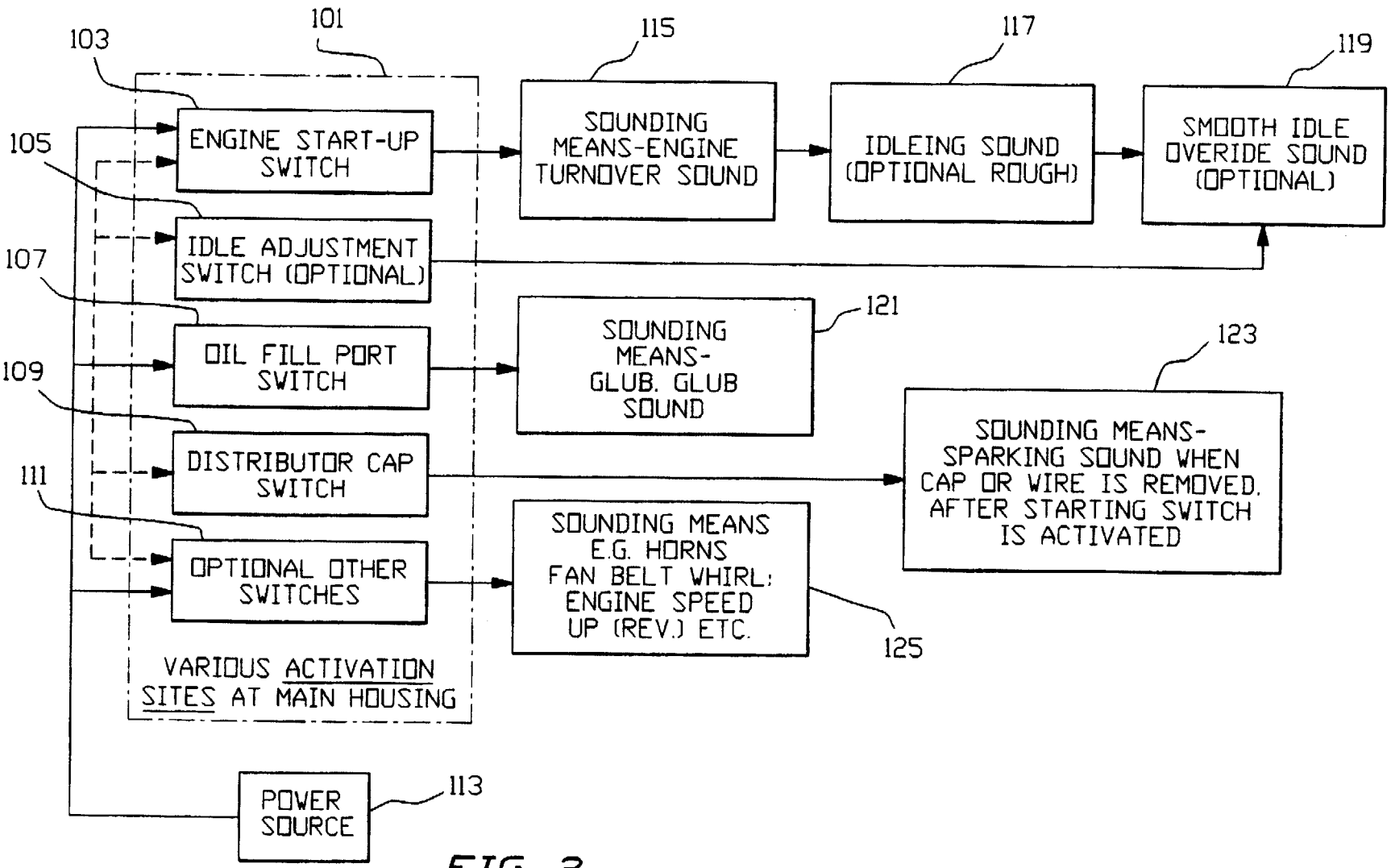
FIG. 2 shows a diagrammatic representation of the functional aspects of one preferred embodiment of the present invention toy engine device, along with optional, yet preferred, features.

FIG. 2 shows a diagrammatic representation of various arrangements for the functional aspects of some preferred embodiments of the present invention toy engine device. Specifically, block 101 represents a plurality of activation sites located at various locations on the main housing of the real-sounding toy engine. The activation sites have on-off switches located therein which, when turned on, activate sound-producing mechanisms. Thus, the blocks contained within block 101 represent various switches. Block 103—shows an engine start-up switch; block 105—an idle adjustment switch which is optional, but preferred; block 107—an oil fill port switch; block 109—a distributor cap switch; and block 111—optional additional switches. Blocks 103, 107 and 111 are connected directly to power source 113, as shown, and the other switch blocks are indirectly connected thereto via connection to other switches. (In those features in which the switches are indirectly connected to the power source through another switch, then both the switch and the switch which it passes through to the power source must be "on" to activate that feature.)

Specifically, when the engine start-up switch 103 is activated, sound-producing mechanism 115 produces the sound of an engine turning over, and, thereafter, sound-producing mechanism 117 produces an idling engine sound. (Mechanism 115 and 117 may be a single sequentially sounding means or two separate means.) Optionally, idling sound-producing mechanism 117 may generate a rough idle (discussed above). These sounds from mechanism 117 may cease after a predetermined time or until switch 103 is turned off. Switch 105 may be spring loaded and return to "off" automatically and thus may activate the smooth idle sound-producing mechanism 119 and be automatically reset for future use.

When oil fill port switch 107 is turned on, an oil pouring sound, and a sound means 121, is activated to produce a glub, glub, glub sound. This would sound until the switch 107 is deactivated or would sound for a predetermined interval.

When distributor cap switch 109 is turned on, e.g. by the removal of a distributor cap or wires, sounding means 123 is activated to produce a sparking sound. Likewise, other optional switch 111 may be turned on to activate other sounding means 125 to beep or honk a horn, to make a whirling sound, to rev the engine, etc. Lights (not shown) may also be included to be activated with activation of various sounding means, as may be desired.

Obviously, numerous modifications and variations of the present invention are possible in light of the above teachings. It is therefore understood that within the scope of the appended claims, the invention may be practiced otherwise than as specifically described herein.

What is claimed is:

1. A real sound-producing toy engine, which comprises:

(a) a main housing having a simulated automobile engine exterior;

(b) a plurality of activation sites located at said main housing for activating a plurality of different real sounding motor-related sounds;

(c) a plurality of switches, there being at least one for each of said activation sites which is connected thereto, each of said switches having an off-position and an on-position, each of said switches being also connected to at least one sound-producing means and being connected to a power source;

(d) an engine start-up activation site being one of said plurality of activation sites and an engine start-up switch connected to said engine start-up activation site, said engine start-up switch being connected to an engine start-up sound-producing means capable of producing an engine start-up sound, including a running engine sound which simulates a turning over of an engine followed by an idling engine, said engine start-up sound-producing means being one of said at least one sound-producing means; and, (e) at least one power source operably connected to said plurality of switches so as to activate a corresponding one of said plurality of activation sites to operate a corresponding one of said at least one of sound-producing means when said plurality of switches are in their on-positions, wherein said at least one power source is said power source when a number of said at least one power source is one.

2. The toy engine of claim 1, wherein said engine start-up activation site is a rotatable keyhole having a first position corresponding to said engine start-up switch off-position, and having a second position corresponding to said engine start-up switch on-position, and further includes a key for insertion in and rotation of said keyhole for turning said engine start-up switch to said engine start-up switch on-position and opposite rotation for turning said engine start-up switch to said engine start-up switch off-position.

3. The toy engine of claim 1, wherein said engine start-up sound-producing means of said engine start-up activation site includes a first sound simulating a revving engine and a second simulating an idling engine.

4. The toy engine of claim 2, wherein said sound producing means of said engine start-up activation site includes a first sound simulating a revving engine and a second sound simulating an idling engine.

5. The toy engine of claim 1, wherein said sound-producing means of said engine start-up activation site includes a first sound simulating a turning over engine and a second sound simulating an idling engine.

6. The toy engine of claim 2, wherein said sound-producing means of said engine start-up activation site includes a first sound simulating a turning over engine and a second sound simulating an idling engine.

7. The toy engine of claim 1, wherein one of said plurality of activation sites includes an oil fill port, said oil fill port having a pressure switch to activate an oil fill port sound-producing means, said pressure switch being one of said plurality of switches, and further including a separate simulated oil container insertable into said oil fill port such that when said separate simulated oil container is inserted into said oil fill port and said pressure switch is moved from a pressure switch off-position to a pressure switch on-position, said oil fill port sound-producing means produces a pouring sound simulating the glubbing of air pockets when oil is poured from a container into an engine.

8. The toy engine of claim 1, wherein another one of said plurality of activation sites includes simulated spark plugs, wires running from said simulated spark plugs to a distributor cap, a distributor cap, and a sparking switch being one of said plurality of switches and being under said distributor cap which is in a spark switch off-position when said distributor cap is filled thereon and is in a spark switch on-position when said distributor cap is removed therefrom, such that when said distributor cap is removed therefrom, a sparking sound-producing means being one of said at least one sound-producing means produces a simulated sparking sound.

9. The toy engine of claim 1, wherein said main housing includes a simulated, removable air filter.

10. The toy engine of claim 1, wherein said main housing includes a simulated removable valve cover.

11. A real sound-producing toy engine, which comprises:

(a) a main housing having a simulated automobile engine exterior;

(b) a plurality of activation sites located at said main housing for activating a plurality of different real sounding motor-related sounds;

(c) a plurality of switches, there being at least one for each of said activation sites which is connected thereto, each of said switches having an off-position and an on-position, each of said switches being also connected to at least one of a plurality of sound-producing means and being connected to a power source;

(d) an engine start-up activation site being one of said plurality of activation sites and an engine start-up switch connected to said engine start-up activation site, said engine start-up switch being connected to an engine start-up sound-producing means capable of producing an engine start-up sound, including a rough running engine sound which audibly produces intermittent sounds of differing periodicity, said engine start-up sound-producing means being one of said at least one sound-producing means;

(e) an idle adjustment activation site being one of said plurality of activation sites and an idle switch being one of said plurality of switches, said idle adjustment activation site having a rotatable member connected to said idle switch, said idle switch being connected to said engine start-up activation site, and having an idle switch off-position and an idle switch on-position and when said idle switch is in said idle switch on-position, said rough running engine sound is overrun so as to activate an idle adjustment sound-producing means having a smooth running sound with intermittent sounds of substantially fixed periodicity, said idle switch being connected to said power source and said idle adjustment sound-producing means being one of said plurality of sound-producing means; and, (f) at least one power source operably connected to said plurality of switches so as to activate said plurality of activation sites to operate said plurality of sound-producing means when said plurality of switches are in their on-position wherein said at least one power source is said power source when a number of said at least one power source is one.

12. The toy engine of claim 11, wherein said engine start-up activation site is a rotatable keyhole having a first position corresponding to said engine start-up switch off-position, and having a second position corresponding to said engine start-up switch on-position, and further includes a key for insertion in and rotation of said keyhole for turning said engine start-up switch to said engine start-up switch on-position and opposite rotation for turning said engine start-up switch to said engine start-up switch off-position.

13. The toy engine of claim 11, wherein said sound-producing means of said engine start-up activation site includes a first sound simulating a revving engine and a second sound simulating an idling engine.

14. The toy engine of claim 12, wherein said sound-producing means of said engine start-up activation site includes a first sound simulating a revving engine and a second sound simulating an idling engine.

15. The toy engine of claim 11, wherein said sound-producing means of said engine start-up activation site includes a first sound simulating a turning over engine and a second sound simulating an idling engine.

16. The toy engine of claim 12, wherein said sound-producing means of said engine start-up activation site includes a first sound simulating a turning over engine and a second sound simulating an idling engine.

17. The toy engine of claim 11, wherein one of said plurality of activation sites includes an oil fill port, said oil fill port having a pressure switch to activate an oil fill port sound-producing means, said pressure switch being one of said plurality of switches, and further including a separate simulated oil container insertable into said oil fill port such that when said separate simulated oil container is inserted into said oil fill port and said pressure switch is moved from a pressure switch off-position to a pressure switch on-position, said oil fill port sound-producing means produces a pouring sound simulating the glubbing of air pockets when oil is poured from a container into an engine.

18. The toy engine of claim 11, wherein another one of said plurality of activation sites includes simulated spark plugs, wires running from said simulated spark plugs to a distributor cap, a distributor cap, and a sparking switch being one of said plurality of switches and being under said distributor cap which is in a spark switch off-position when said distributor cap is filled thereon and is in a spark switch on-position when said distributor cap is removed therefrom, such that when said distributor cap is removed therefrom, a sparking sound-producing means being one of said at least one sound-producing means produces a simulated sparking sound.

19. The toy engine of claim 11, wherein said main housing includes a simulated removable air filter.

20. The toy engine of claim 11, wherein said main housing includes a simulated, removable valve cover.

* * * * *